United States Patent [19]

Tokita

[11] Patent Number: 4,537,321

[45] Date of Patent: Aug. 27, 1985

[54] CATHODE-RAY TUBE

[75] Inventor: Kiyoshi Tokita, Fukaya, Japan

[73] Assignee: Tokyo Shibaura Denki Kabushiki Kaisha, Kawasaki, Japan

[21] Appl. No.: 564,197

[22] Filed: Dec. 22, 1983

[30] Foreign Application Priority Data

Mar. 9, 1983 [JP] Japan ..... 58-37439
Mar. 31, 1983 [JP] Japan ..... 58-53511

[51] Int. Cl.[3] ..... H01J 61/30

[52] U.S. Cl. ..... 220/2.1 A; 220/2.1 R; 313/477 R; 358/242

[58] Field of Search ..... 220/2.1 R, 2.1 A, 2.3 R, 220/2.3 A; 313/477 R; 358/242, 243, 217, 250, 251, 252, 253

[56] References Cited

U.S. PATENT DOCUMENTS

| | | | |
|---|---|---|---|
| 3,089,052 | 5/1963 | Bisbing | 220/2.1 A X |
| 3,720,345 | 3/1973 | Logue | 220/2.1 A |
| 3,835,250 | 9/1974 | Kaljuko et al. | 220/2.1 A X |
| 3,839,002 | 10/1974 | Verhoeven et al. | 220/2.1 A X |
| 4,029,898 | 6/1977 | Belentepe et al. | 220/2.3 A X |
| 4,206,534 | 6/1980 | Amstutz et al. | 29/25.13 |
| 4,210,935 | 7/1980 | Mitchell et al. | 220/2.1 A X |

FOREIGN PATENT DOCUMENTS 2407527 1/1976 Fed. Rep. of Germany .

*Primary Examiner*—Steven M. Pollard
*Attorney, Agent, or Firm*—Cushman, Darby and Cushman

[57] ABSTRACT

A flatter faceplate cathode-ray tube. If maximum effective dimensions perpendicular to a tube axis, which correspond to the distances between the center of the inner surface and a peripheral portion along the lateral axis, between the center of the inner surface and a peripheral portion along the longitudinal axis, and between the center of the inner surface and a corner along the diagonal axis, are represented by Ss, Sl and Sd, respectively. The ratio between these three values is selected to be 3:4:5. The distances between the center of the inner surface and those individual points along the tube axis defined as ΔD, ΔL and ΔS, respectively, are limited as follows to obtain the dimensions of a flatter source CRT:

$$0.06 \leqq \Delta D \leqq 0.12,$$

$$0.05 \leqq \Delta L \leqq 0.10,$$

$$0.04 \leqq \Delta S \leqq 0.80.$$

11 Claims, 10 Drawing Figures

CATHODE-RAY TUBE

BACKGROUND OF THE INVENTION

The present invention relates to a cathode-ray tube, and more specifically to a glass panel section of a cathode-ray tube.

Conventionally, in a cathode-ray tube 10 as shown in FIG. 1, a phosphor screen is formed on the inner surface of a faceplate 22 of a glass panel section 20, and a funnel section 30 with a deflection yoke device (not shown) on its outer periphery is sealed on a skirt 24 of the glass panel section 20. A neck 40 protrudes from the funnel section 30. An electron gun (not shown) for emitting electron beam is received in the neck 40. The glass panel section 20, the funnel section 30, and the neck 40 together constitute the envelope of the cathode-ray tube 10. The envelope is exhausted to a high vacuum.

In the prior art cathode-ray tube 10 of this type, as shown in FIG. 1, the inner and outer surfaces of the faceplate 22 of the glass panel section 20 are curved with a certain curvature so as to project outward. The corners of the faceplate 22 are also curved. Thus, the front view of the faceplate 22 is not rectangular, but rather rounded as a whole, as shown in FIGS. 1 and 2. If the radii of curvature of the inner surface of the faceplate 22 along the lateral axis (Y—Y), longitudinal axis (X—X) and diagonal axis (D—D) are Rsi, Rli and Rdi, respectively, and if those of the outer surface along these three axes are Rso, Rlo and Rdo, respectively, as shown in FIGS. 3A to 3C, the faceplate 22 is generally designed and manufactured in a manner such that $Rsi=Rli=Rdi=Ri$ and $Rso=Rlo=Rdo=Ro$, wherein Ri and Ro are predetermined values.

The reason why the inner and outer surfaces and corners of the faceplate 22 are curved in the aforesaid manner is that the inside of the envelope of the cathode-ray tube is kept at a high vacuum. Therefore, a substantial inward stress attributed to the difference between the atmospheric pressure and the internal pressure of the envelope is applied to the central portion of the faceplate 22 and a substantial outward stress is applied to the peripheral portion of the faceplate 22. Accordingly, the envelope may possibly implode if it is subjected to a small impact or if glass, of which the envelope is made, has a flaw. In order to reduce the possibility of such implosion, the prior art faceplate 22 is generally rounded as a whole.

However, the faceplate 22 thus designed is considered injurious to the eyes of viewers. An ideal screen for the viewers' eyes has been found to be flat rectangular screen in which the ratio among the maximum effective dimensions perpendicular to the tube axis (Z—Z), which respectively correspond to the distance between the center of the inner surface and a peripheral portion along the lateral axis (Y—Y), that between the center of the inner surface and a peripheral portion along the longitudinal axis (X—X), and that between the center of the inner surface and a corner along the diagonal axis (D—D) is 3:4:5. The prior art round faceplate doesn't have the desired ratio between the three dimensions, and is regarded as unfit as a picture screen.

A 14-inch cathode-ray tube is designed so that $Rsi=Rli=Rdi=Ri\approx 551$ mm and $Rso=Rlo=Rdo=Ro\approx 575$ mm, while a 26-inch cathode-ray tube is designed so that $Rsi=Rli=Rdi=Ri\approx 1{,}034$ mm and $Rso=Rlo=Rdo=Ro\approx 1{,}100$ mm. If the maximum effective length of the faceplate 22 along its longitudinal axis (X—X), that of the faceplate 22 along lateral axis (Y—Y) and that of the faceplate 22 along diagonal axis (D—D) are 2Sl, 2Ss and 2Sd, respectively, the 14-inch cathode-ray tube is designed so that $Sl\approx 140.4$ mm, $Ss\approx 105.3$ mm and $Sd\approx 166.7$ mm, while the 26-inch cathode-ray tube is designed so that $Sl\approx 263.9$ mm, $Ss\approx 197.9$ mm and $Sd\approx 313.2$ mm. Thus, in the cathode-ray tubes of both these types, the ratio Ss:Sl:Sd is approximately 3:4:4.75.

The harmful visual effect and the fear of implosion can be removed by greatly thickening the faceplate 22. If the faceplate 22 is thickened, however, the cathode-ray tube will increase in weight and cost and will not be prefered practically in the point of the optical properties.

SUMMARY OF THE INVENTION

The object of the present invention is to provide a cathode-ray tube whose glass panel has a rectangular faceplate flattened as much as possible.

According to the present invention, there is provided a cathode-ray tube, which comprises a glass panel constituting a glass envelope having a tube axis, the glass panel including a substantially rectangular faceplate having curved inner and outer surfaces, a pair of long sides, a pair of short sides and four curved corners at which the corresponding long and short sides meet, the inner surface being defined by a first radius of curvature Rs set within a plane containing the tube axis and passing through the center points of the two sides, a second radius of curvature Rl set within a plane containing the tube axis and passing through the center points of the two short sides, and a third radius of curvature Rd set within a plane containing the tube axis and a diagonal connecting a pair of diagonally opposite corners among the four corners, the radii of curvature Rs, Rl and Rd, the maximum effective lateral dimension 2Ss between the pair of long sides, the maximum effective longitudinal dimension 2Sl between the pair of short sides and the maximum effective diagonal dimension 2Sd between the pair of diagonally opposite corners being given by $$0.06 \leqq \frac{Rd - \sqrt{(Rd)^2 - (Sd)^2}}{Sd} \leqq 0.12,$$

$$0.05 \leqq \frac{Rl - \sqrt{(Rl)^2 - (Sl)^2}}{Sl} \leqq 0.10,$$

$$0.04 \leqq \frac{Rs - \sqrt{(Rs)^2 - (Ss)^2}}{Ss} \leqq 0.08.$$

In a preferred embodiment, center regions of the long sides are made thicker than those of the short sides.

DETAILED DESCRIPTION OF THE PREFERRED EMBODIMENT

Figure 4:
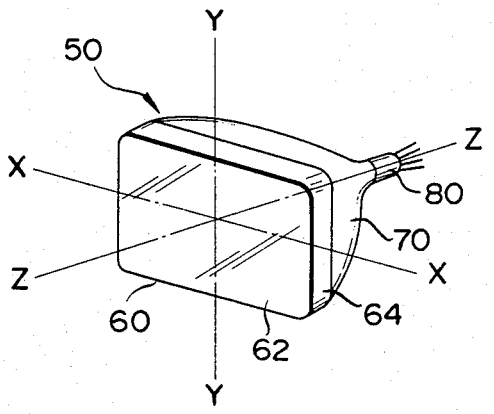
FIG. 4 is a perspective view schematically showing an envelope of a cathode-ray tube according to one embodiment of the present invention.

Referring now to FIG. 4, there is shown a cathode-ray tube 50 according to one embodiment of the present invention. In this cathode-ray tube, a funnel section 70 is hermetically sealed on a skirt 64 of a glass panel section 60 to be mentioned later, thus forming the envelope. The envelope is exhausted to a high vacuum. An electron gun for emitting an electron beam or electron beam is contained in a neck 80 which extends from the funnel section 70 along the tube axis or axis Z—Z. A deflection yoke device (not shown) for deflecting the electron beam or electrom beams is provided on the outer periphery of the funnel section 70. Formed on the inner surface of a faceplate 62 of the glass panel section 60 is a phosphor screen (not shown) on which the electron beam impinges for emitting light. Also, in the case of a color cathode-ray tube, a shadow mask (not shown) is held inside the glass panel section 60, facing the phosphor screen.

Figure 1:
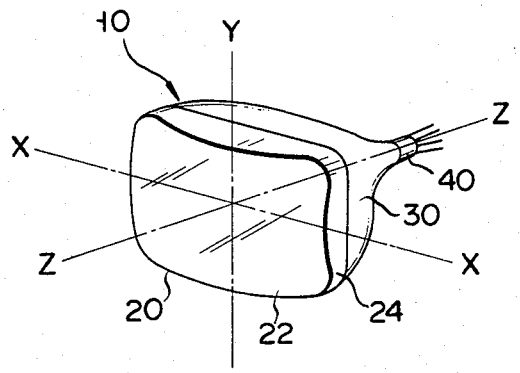
FIG. 1 PRIOR ART
FIG. 1 is a perspective view schematically showing an envelope of a prior art cathode-ray tube.
Figure 2:
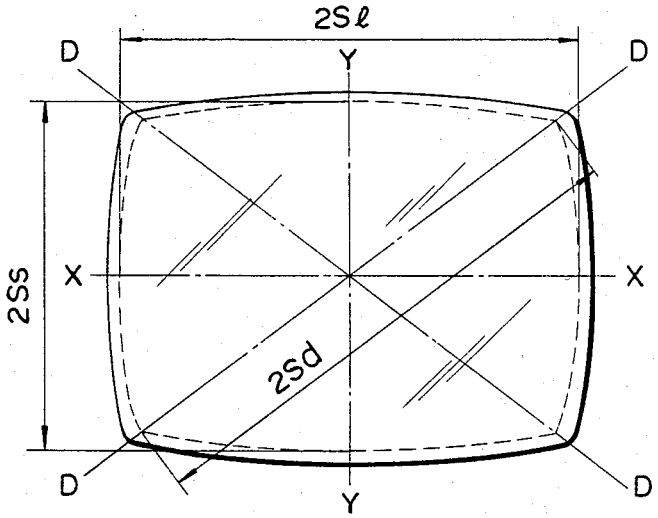
FIG. 2 PRIOR ART
FIG. 2 is a schematic front view of the faceplate shown in FIG. 1.
Figure 3A:
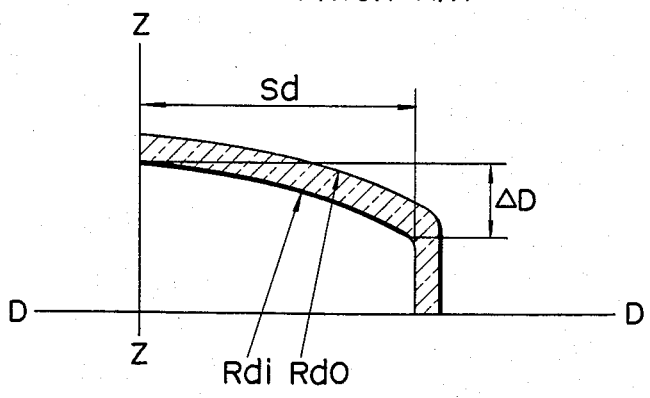
FIG. 3A PRIOR ART
FIGS. 3A to 3C are partial sectional views schematically showing the glass panel of FIG. 1 taken along the diagonal axis (D—D), longitudinal axis (X—X) and lateral axis (Y—Y) of FIG. 2, respectively.
Figure 3B:
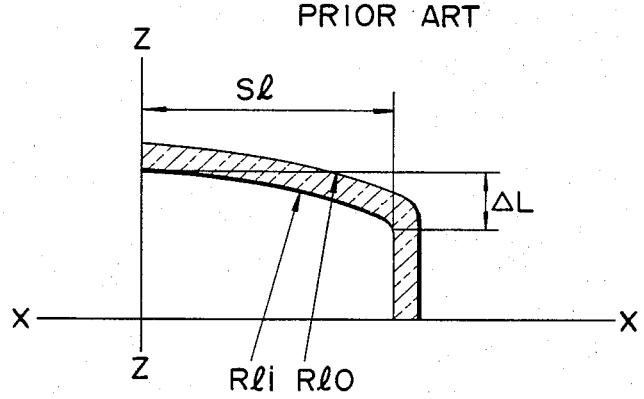
FIG. 3B PRIOR ART
Figure 3C:
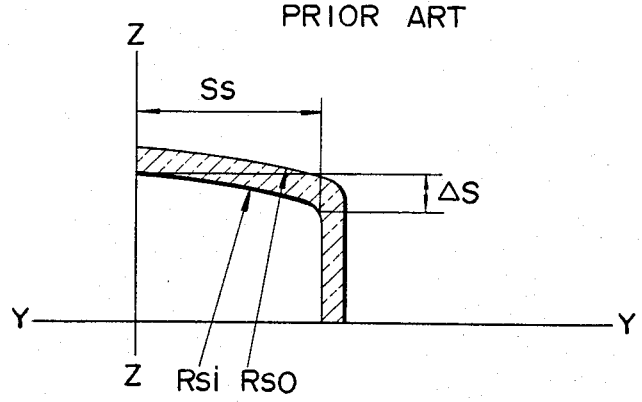
FIG. 3C PRIOR ART
Figure 5:
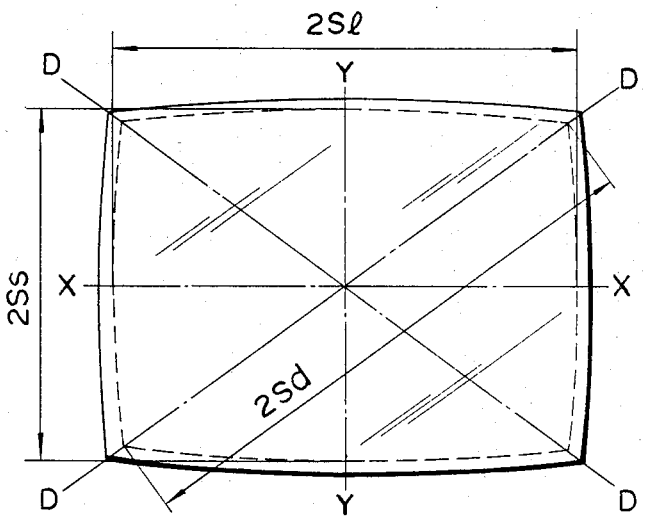
FIG. 5 is a schematic front view of the faceplate shown in FIG. 4.
Figure 6A:
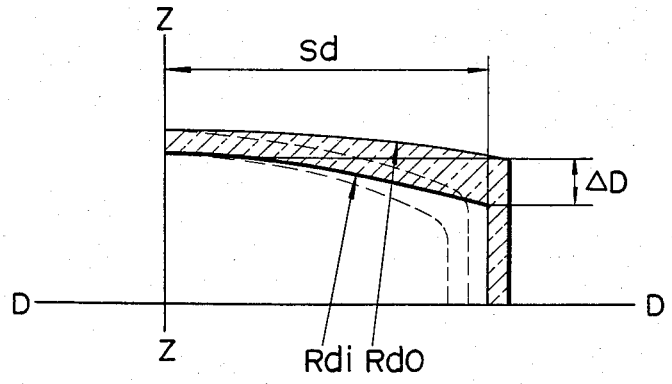
FIGS. 6A to 6C are partial sectional views schematically showing the glass panel of FIG. 4 taken along the diagonal axis (D—D), longitudinal axis (X—X) and lateral axis (Y—Y) of FIG. 5, respectively.
Figure 6B:
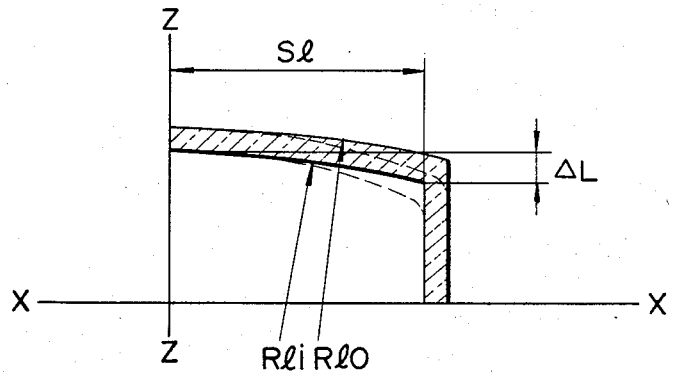
Figure 6C:
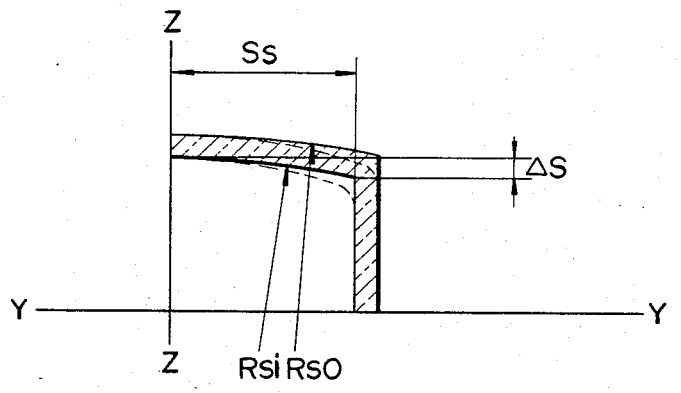

As shown in FIG. 4, the faceplate 62 of the cathode-ray tube of the invention has inner and outer surfaces flatter than those of the faceplate 22 of the prior art cathode-ray tube shown in FIG. 1. Moreover, the front view of the faceplate 62 is more similar to a rectangle having the ratio of 3:4:5 among the maximum effective dimensions perpendicular to the tube axis (Z—Z), which respectively correspond to the distance between the center of the inner surface and a peripheral portion along the lateral axis (Y—Y), that between the center of the inner surface and a peripheral portion along the longitudinal axis (X—X), and that between the center of the inner surface and a corner along the diagonal axis (D—D). The corners of the faceplate 62 are substantially right-angled. These features of the invention are evident from the front view of FIG. 5 showing the faceplate 62 compared with the prior art faceplate 22 of FIG. 2, and the partial sectional views of FIGS. 6A to 6C compared with FIGS. 3A to 3C. In FIGS. 6A to 6C, partial cross sections of the prior art faceplate 22 shown in FIGS. 3A to 3C are represented by broken lines for comparison.

The faceplate 62 shown in FIGS. 4, 5 and 6A to 6C is formed in consideration of the following circumstances. The inventor paid attention to the distances between the center of the inner surface of the faceplate 62 and the periphery of the inner surface along the tube axis Z—Z when the inner surface is formed into a curved surface with a certain curvature. These distances will hereinafter be referred to as flatness indexes. The flatness indexes include those indexes which represent the distance ΔD along the diagonal axis or axis D—D between the center of the inner surface of the faceplate 62 and the corner of the inner surface of the faceplate 62 along the tube axis, as shown in FIG. 6A; the distance ΔL along the longitudinal axis or axis X—X between the center of the inner surface of the faceplate 62 and the center of the short side of the inner surface of the faceplate 62 along the tube axis, as shown in FIG. 6B; and the distance ΔS along the lateral axis or axis Y—Y between the center of the inner surface of the faceplate 62 and the center of the long side of the inner surface of the faceplate 62 along the tube axis, as shown in FIG. 6C. Based on the geometrical relationships shown in FIGS. 5 and 6A to 6C, the indexes ΔD, ΔL and ΔS may be expressed as follows:

$$\Delta D = \frac{Rdi - \sqrt{(Rdi)^2 - (Sd)^2}}{Sd}, \quad (1)$$

$$\Delta L = \frac{Rli - \sqrt{(Rli)^2 - (Sl)^2}}{Sl}, \quad (2)$$

$$\Delta S = \frac{Rsi - \sqrt{(Rsi)^2 - (Ss)^2}}{Ss}. \quad (3)$$

Here, Rsi, Rli and Rdi are the radii of curvature of the inner surface of the faceplate 62 along the lateral axis or axis Y—Y, the longitudinal axis or axis X—X and diagonal axis or axis D—D, respectively. Ss, Sl and Sd are the distances between the center and long side of the inner surface of the faceplate 62 along the axis Y—Y, between the center and short side of the inner surface of the faceplate 62 along the axis X—X, and between the center and corner of the inner surface of the faceplate 62 along the axis D—D, respectively. As shown in FIG. 5, 2Ss, 2Sl and 2Sd each represent a maximum effective dimension of the inner surface of the faceplate 62, which perpendicularly crosses a tube axis (Z—Z), and they respectively correspond to the distance between the peripheral portions along the lateral axis (Y—Y), that between the peripheral portions along the longitudinal axis (X—X) and that between the corners along the diagonal axis (D—D). To avoid an awkward visual effect, it is necessary that the ratio 2Ss:2Sl:2Sd be approximately 3:4:5.

As seen from equations (1), (2) and (3), the greater the flatness indexes ΔS, ΔL and ΔD, the rounder the general configuration of the screen will be, and the greater the awkward visual effect caused by the screen will be. In other words, if the flatness indexes ΔS, ΔL and ΔD are reduced, the screen will be flattened to improve visual comfort.

After considering various conditions including the implosion characteristic of the cathode-ray tube as well as the flatness indexes, the inventor discovered the following facts.

If the ratio between the maximum effective dimension between the peripheral portions along the lateral axis (Y—Y) and that between the peripheral portions along the longitudinal axis (X—X), i.e., the ratio 2Ss:2Sl, is 3:4, the flatness index ΔD for the direction of the axis D—D is most important to the flatness of the faceplate 62. The flatness indexes ΔL and ΔS for the directions of the axes X—X and Y—Y are the second and third in importance, respectively, to make for the flatness of the faceplate 62. Even if only the flatness index ΔD for the direction of the axis D—D is adequate, the faceplate 62 will be flat enough.

If the radius of curvature of the inner surface of the faceplate 62 is made greater than that of the prior art faceplate in consideration of the aforementioned flattening conditions, to set the ratio between the maximum effective dimensions 2Ss, 2Sl and 2Sd to 3:4:5, then the upper limits of the flatness indexes ΔD, ΔL and ΔS for the directions of the axes D—D, X—X and Y—Y are 0.12, 0.10 and 0.08, respectively. The lower limits of the flatness indexes ΔD, ΔL and ΔS are 0.06, 0.05 and 0.04, respectively. In this case, the anti-implosion characteristic of the faceplate 62 is not deteriorated, and the glass panel section 60, which is thicker, is only a little heavier than the prior art glass panel section. Thus, the indexes ΔD, ΔL and ΔS are limited as follows:

$$0.06 \leqq \Delta D \leqq 0.12 \quad (4),$$

$$0.05 \leqq \Delta L \leqq 0.10 \quad (5),$$

$$0.04 \leqq \Delta S \leqq 0.80 \quad (6).$$

To strengthen the faceplate 62 so that it can resist the maximum outward stress applied to its peripheral portions, the radii of curvatures Rsi, Rli and Rdi of the inner surface of the faceplate 62 for the directions of the individual axes can be varied within the ranges for the individual flatness indexes given by expressions (4), (5) and (6). Namely, in making the peripheral portions of the faceplate 62 thicker than the central portion thereof, the flatness index for the peripheral portion extending parallel to the axis Y—Y, which represents the distance ΔEs between each the center of the short side and its corresponding corner of the inner surface of the faceplate 62 along the tube axis, must be within the range for the flatness index ΔS for the direction of the axis Y—Y defined by expression (6). Likewise, the flatness index for the peripheral portion extending parallel to the axis X—X, which represents the distance ΔEl between each the center of the long side and its corresponding corner of the inner surface of the faceplate 62 along the tube axis, must be within the range for the flatness index ΔL for the direction of the axis X—X defined by expression (5). Accordingly, based on the relationship between the flatness index for the direction of the axis D—D and the flatness index ΔL or ΔS for the direction of the axis X—X or Y—Y, the flatness indexes ΔEs and ΔEl for the peripheral portion are expressed and limited as follows:

$$0.04 \leqq \Delta Es \leqq 0.08 \quad (7)$$

wherein, $$\Delta Es = \frac{(Rdi - \sqrt{(Rdi)^2 - (Sd)^2}) - (Rli - \sqrt{(Rli)^2 - (Sl)^2})}{Ss},$$

$$0.05 \leqq \Delta El \leqq 0.10 \quad (8)$$

wherein, $$\Delta El = \frac{(Rdi - \sqrt{(Rdi)^2 - (Sd)^2}) - (Rsi - \sqrt{(Rsi)^2 - (Ss)^2})}{Sl}.$$

Here let us suppose that Rso, Rlo and Rdo are the radii of curvature of the outer surface of the faceplate 62 along the lateral axis or axis Y—Y, the longitudinal axis or axis X—X, and the diagonal axis or axis D—D, respectively. Thereupon, the radii of curvature Rso, Rlo and Rdo may be made greater than the radii of curvature Rsi, Rli and Rdi of the inner surface of the faceplate 62 for the directions of their corresponding axes, respectively. Thus, if the outer surface of the faceplate 62 is flattened additionally, the peripheral portions of the faceplate 62 are thickened for strength to counter implosion. This will not, however, increase the gross weight of the glass panel section 60 very much.

In the embodiment described above, the radii of curvature Rsi, Rli, Rdi, Rso, Rlo and Rdo of the inner and outer surfaces for the directions of the lateral axis (Y—Y), longitudinal axis (X—X) and diagonal axis (D—D) are described as single radii, that is, radii of spheres. However, the present invention is not limited to that embodiment, and the radii of curvature Rsi, Rli, Rdi Rso, Rlo and Rdo of the inner and outer surfaces may be given as combined radii of complex curvature. For example, the radius of curvature Rsi of the inner surface for the lateral axis (Y—Y) may vary gradually from the center to peripheral portion of the faceplate 62. Namely, the combined radii of curvature may take individual values obtained by approximately expanding a single radius of curvature in progression.

Specific numerical values used in the aforementioned embodiment of the invention will now be described. First, in the 15-inch cathode-ray tube, the radii of curvature of the inner surface of the faceplate 62 were made equal to one another and greater than the prior art values, that is, $Rsi = Rli = Rdi = 1{,}300$ mm. For the radii of curvature of the outer surface of the faceplate 62, $Rso = Rlo = Rdo = 1{,}400$ mm was given. Half the maximum effective dimensions of the faceplate 62 for the directions of the individual axes were Ss≈106.7 mm, Sl≈142.2 mm and Sd≈177.8 mm. Thus, the ratio Ss:Sl:Sd was set to 106.7:142.2:177.8≈3:4:5.

In this case, the flatness indexes ΔD, ΔL and ΔS for the directions of the individual axes given by equations (1) to (3) and the flatness indexes ΔEs and ΔEl for the peripheral portions parallel to the lateral axis (Y—Y) and longitudinal axis (X—X) given by expressions (7) and (8) are ΔD≈0.069, ΔL≈0.055, ΔS≈0.041, ΔEs≈0.041 and ΔEl≈0.055. All these approximate values are within the ranges given by expressions (4) to (8). Since the radii of curvature Rso, Rlo and Rdo of the outer surface of the faceplate 62 are greater than the radii of curvature Rsi, Rli and Rdi of the inner surface, the peripheral portions of the faceplate 62 are thicker than the central portion thereof. The maximum stress at the center of the long side attributed to expansion is equivalent to the value for the prior art glass panel section 20. According to this embodiment, therefore, the flatness of the screen is improved and the glass panel section 60 can enjoy the same anti-implosion characteristic by only slightly increasing its weight.

Secondly, in the 27-inch cathode-ray tube, the radii of curvature of the outer surface of the faceplate 62 were set to a fixed value, that is, $Rso = Rlo = Rdo = Ro = 1{,}800$ mm, while those of the inner surface were set to different values, that is, $Rsi = 1{,}300$ mm, $Rli = 1{,}550$ mm and $Rdi = 1{,}450$ mm. Half the maximum effective lengths of the faceplate 62 for the directions of the individual axes were Ss≈197.1 mm, Sl≈262.8 mm and Sd≈328.5 mm. Thus, the ratio Ss:Sl:Sd was set to 197.1:262.8:328.5≈3:4:5, as in the foregoing embodiment.

In this case, the flatness indexes ΔD, ΔL and ΔS for the directions of the individual axes given by equations (1) to (3) and the flatness indexes ΔEs and ΔEl for the peripheral portions parallel to the lateral axis (Y—Y) and longitudinal axis (X—X) given by expressions (4) to (8) are ΔD≈0.115, ΔL≈0.085, ΔS≈0.076, ΔEs≈0.077 and ΔEl≈0.086. All these approximate values are within the ranges given by expressions (4) to (8). The radii of curvature of the inner surface of the faceplate 62 are different, and that for the direction of the lateral axis (Y—Y) is the smallest one. Therefore, the faceplate 62 is thickest at the center of the long side. The glass panel section 60 of this embodiment has an advantage over that of the foregoing embodiment in the anti-implosion characteristic. Thus, the glass panel section 60 has the same anti-implosion characteristic of the prior art glass panel section if the faceplate 62 is made only one millimeter thicker than the prior art faceplate 22.

What is claimed is:

1. A cathode-ray tube (CRT) comprising:

a substantially funnel-shaped glass portion having a tube axis; and a substantially rectangular faceplate, joined with said funnel-shaped portion to form the envelope of said CRT, said faceplate having curved inner and outer surfaces, a pair of long sides, a pair of short sides and four curved corners at which corresponding long and short sides meet, the dimensions of the faceplate being chosen so as to satisfy the relation $$0.06 \leqq \frac{(Rd - \sqrt{(Rd)^2 - (Sd)^2})}{Sd} \leqq 0.12.$$

wherein

Rd is the radius of curvature of the inner surface in a plane including said tube axis and a diagonal connecting a pair of diagonally opposite corners among said four corners, and Sd is one half of the diagonal dimension distance between a pair of diagonally opposite corners.

2. A CRT according to claim 1 wherein the dimensions of said faceplate are further chosen so as to satisfy the relation $$0.05 \leqq \frac{(Rl - \sqrt{(Rl)^2 - (Sl)^2})}{Sl} \leqq 0.10.$$

wherein:

Rl is the radius of curvature of the inner surface in a plane including said tube axis and the center points of said two short sides, and Sl is one half of the longitudinal dimension between the pair of short sides.

3. A CRT according to claim 2 wherein the dimensions of said faceplate are further chosen so as to satisfy the relation $$0.04 \leqq \frac{(Rs - \sqrt{(Rs)^2 - (Ss)^2})}{Ss} \leqq 0.08.$$

wherein:

Rs is the radius of curvature of the inner surface in a plane including said tube axis and the center points of said two long sides, and Ss is one half of the lateral dimension between the pair of long sides.

4. A CRT according to claim 3, wherein the dimensions of the faceplate are further chosen so that the ratio between a lateral dimension 2Ss between the pair of long sides, said longitudinal dimension 2Sl between the pair of short sides and said diagonal dimension 2Sd between the pair of diagonally opposite corners is substantially 3:4:5.

5. A CRT according to claim 4 wherein the faceplate dimensions are further chosen such that radii of curvature of the outer surface of said faceplate are greater than the radii of curvature Rs, Rl and Rd of the inner surface of said faceplate, respectively.

6. A CRT according to claim 5, wherein the central portions of the long sides of said faceplate are thicker than the short sides and the corners.

7. A CRT according to claim 6, wherein the dimensions of the faceplate are further chosen to satisfy the relation $$0.05 \leqq \frac{(Rd - \sqrt{(Rd)^2 - (Sd)^2}) - (Rs - \sqrt{(Rs)^2 - (Ss)^2})}{Sl} \leqq 0.10.$$

8. A CRT according to claim 1, wherein the dimensions of the faceplate are further chosen to satisfy the relation $$0.04 \leqq \frac{(Rd - \sqrt{(Rd)^2 - (Sd)^2}) - (Rl - \sqrt{(Rl)^2 - (Sl)^2})}{Ss} \leqq 0.08.$$

9. A CRT according to claim 1 wherein the dimensions of said faceplate are further chosen so as to satisfy the relation $$0.04 \leqq \frac{(Rs - \sqrt{(Rs)^2 - (Ss)^2})}{Ss} \leqq 0.08.$$

wherein:

Rs is the radius of curvature of the inner surface in a plane including said tube axis and the center points of said two long sides, and Ss is one half of the lateral dimension between the pair of long sides.

10. A CRT according to claim 1, wherein said funnel-shaped portion includes a skirt extending from said faceplate along the tube axis.

11. A CRT according to claim 10, wherein said funnel-shaped portion includes a neck extending along the tube axis.

* * * * *